US005921464A

United States Patent [19]

Seki

[11] Patent Number: 5,921,464

[45] Date of Patent: Jul. 13, 1999

[54] PACKAGING BODY

[75] Inventor: Seizo Seki, Miyagi, Japan

[73] Assignee: Sony Corporation, Tokyo, Japan

[21] Appl. No.: 09/031,719

[22] Filed: Feb. 27, 1998

[30] Foreign Application Priority Data

Mar. 10, 1997 [JP] Japan ..... 9-054997

[51] Int. Cl.[6] ..... B65D 65/26

[52] U.S. Cl. ..... 229/87.05; 383/211; 206/387.1

[58] Field of Search ..... 229/87.05; 206/387.1, 206/497; 383/211

[56] References Cited

U.S. PATENT DOCUMENTS 5,505,375 4/1996 Sato et al. ..... 206/387.1 X 5,560,538 10/1996 Sato et al. ..... 229/87.05

5,749,466 5/1998 Seki ..... 229/87.05 X 5,837,336 11/1998 Ichimura et al. ..... 229/87.05 X

*Primary Examiner*—Jes F. Pascua

*Attorney, Agent, or Firm*—Jay H. Maioli

[57] ABSTRACT

A package for wrapping an object in which an outer packaging film can be positively unsealed without damaging the object or by using a strong force during unsealing. A non-adhered part which becomes an opening tap (10) for unsealing is formed in a part of an overlapped portion of an outer packaging film (2), weakly adhered parts **(11*a*), (11*b*) each having a low degree of adhesiveness are formed at left and right sides of the opening tap (10), and a slit (12) is provided in one weakly adhered part only (11*a*) which allows for the outer packaging film (2)** to be torn easily.

4 Claims, 4 Drawing Sheets

PACKAGING BODY

BACKGROUND OF THE INVENTION

1. Field of the Invention

The present invention relates to a packaging body for an object to be packaged, for example, a cassette case or the like, and more particularly, to a packaging body in which an opening tap is formed in a part of an adhered portion of an outer packaging film and a weakly adhered part with a slit is provided in the vicinity of the opening tap which gives a chance for unsealing the outer packaging film, to thereby improve unsealing of the outer packaging film.

2. Description of the Related Art

Conventionally, for example, when a tape cassette for an audio use, a tape cassette for a video use or the like is planned to be a commercial good and actually placed on the market, a cassette case accommodating therein the cassette of this kind is wrapped with an outer packaging film (ornamental film) and then put on sale.

As an outer packaging film of this kind, there has been used film material made of polypropylene (PP) or the like, which is excellent in toughness and has heat adhesiveness, and a cassette case to be packaged is wrapped with the film. The outer packaging film used for wrapping is sealed by heat-bonding an overlapped portion thereof.

As a general method for unsealing an outer packaging film with which a cassette case is wrapped, there is proposed such a method in which a cut tape is inserted into the outer packing film in advance, and upon unsealing, a leading tip end of the cut tape is pulled out in a predetermined guiding direction, while the tip end is picked up by fore-ends of fingers, so that the outer packaging film is torn and as a result the package comes to be unsealed. However, in the case where the cut tape is used, the leading tip end of the cut tape is difficult to be pinched by the fore-ends of fingers because the leading tip end is adhered to the surface of the outer packaging film. Or in the case where an outer packaging film is torn by the cut tape in circular fashion, the outer packaging film is left on the side of the cassette case, so that such the film left on the case is also manually burdensome in peeling off.

On the other hand, as a method for unsealing with no use of a cut tape, a packaging method is proposed in disclosure of, for example, Japanese Patent Application Publication No. Hei 8-72930. The method will be described with reference to FIG. 1.

An outer packaging film 2 wrapping a cassette case 1, which is an object to be packaged is sealed on a front face 3 of the body thereof and on both left and right side faces 4 and 5 thereof. Both end portions of the outer packaging film 2 are overlapped with each other on the front face 3 of the body of the object and then the overlapped is heat sealed to form a adhered portion 6. A non-adhered portion of the outer packaging film 2 is formed in a middle part of the adhered portion 6 and the non-adhered portion works as an opening tap 7 when the outer packaging film 2 is unsealed. Overlapped portions of the outer packaging film 2 are formed on left and right side faces 4, 5, as viewed, in the case where the outer packaging film is wrapped by a wrapping manner for a caramel, for example, and they are also heat sealed to form side adhered portions 8.

While the packaging body formed as mentioned above is unsealed in such a manner that an end of a finger or the like is inserted into the opening tap 7, an edge portion of the outer packaging film is picked up and the outer packaging film 2 is torn to be unsealed, the outer packaging film 2 having a high toughness made of polypropylene or the like has a problem that it is apt to be stretched with neither breakage nor tearing. If such an outer packaging film is unreasonably tried to be torn, the cassette case receives a strong force, which can cause a breakage of the cassette case. Moreover, while there is another proposal in which a slit 9 is provided in a part of the opening tap 7 and the slit gives an effective chance for easy tearing of the outer packaging film 2, even if a slit is simply provided, the outer packaging film is often wrongly torn, which tends to prevent the opening tap with a slit from being effective in unsealing the outer packaging film.

SUMMARY OF THE INVENTION

In order to solve the above mentioned problem, it is an object of the present invention to obtain a packaging body which makes it possible to avoid wrong tearing of the outer packaging film, which requires no strong force in unsealing the outer packaging film, and thereby which makes the outer packaging film unsealed in an assured manner.

In order to solve the above mentioned problem, a packaging body according to the present invention comprise: a non-adhered part, which will become an opening tap upon unsealing of an outer packaging film in a part of a adhered portion of the outer packaging film; a weakly adhered part having a low degree of adhesiveness provided in parts adjacent to the non-adhered part; and a slit formed in the weakly adhered part.

With the above arrangement, when the opening tap which is formed of the non-adhered part is picked up by ends of fingers or the like and turned up, and the weakly adhered parts at left and right sides of the non-adhered part are further peeled up, the slit makes an effective chance for the outer packaging film to be torn, so that the outer packaging film can be successfully unsealed.

DESCRIPTION OF THE PREFERRED EMBODIMENTS

A packaging body according to the present invention will be described in the case where a cassette case, for example, is wrapped with an outer packaging film, which is an embodiment of the packaging body of the present invention, with reference to the accompanying drawings.

Figure 1:
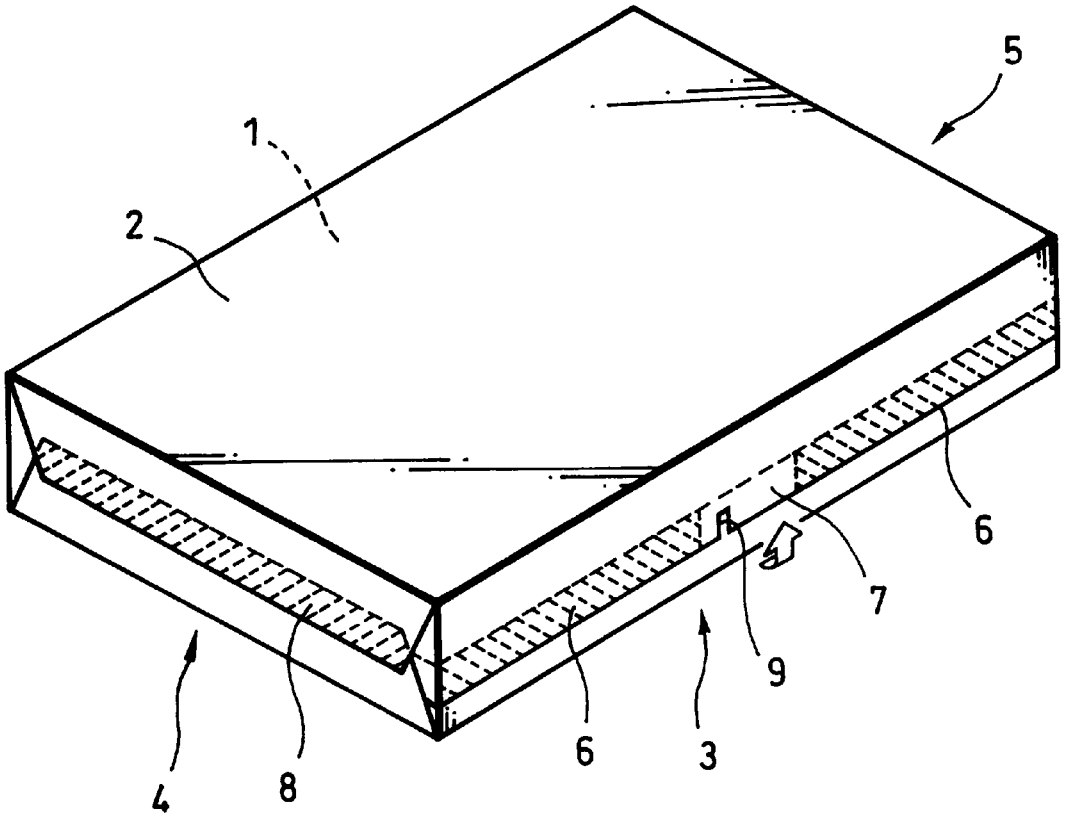
FIG. 1 (PRIOR ART)
FIG. 1 is a perspective view of a conventional outer packaging film in a packaging condition.
Figure 2:
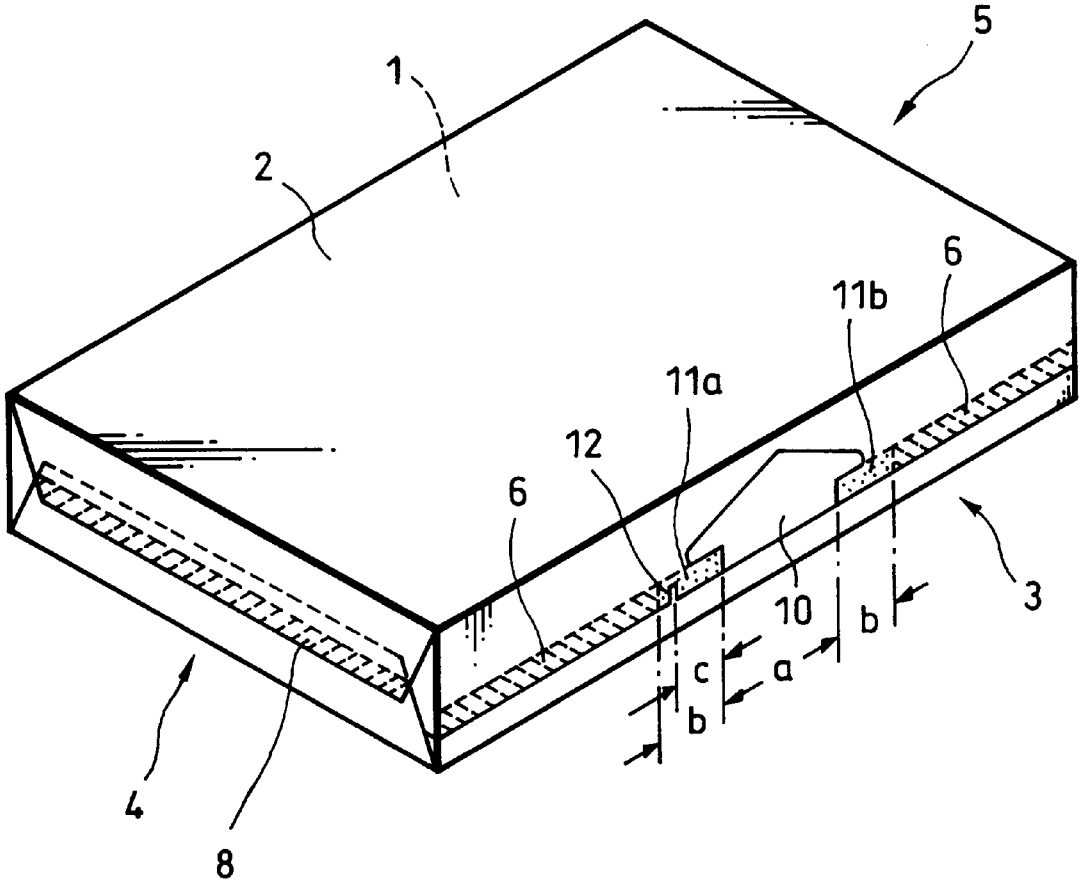
FIG. 2 is a perspective view of an outer packing film to be applied to a packaging body in a packaging condition.
Figure 5:
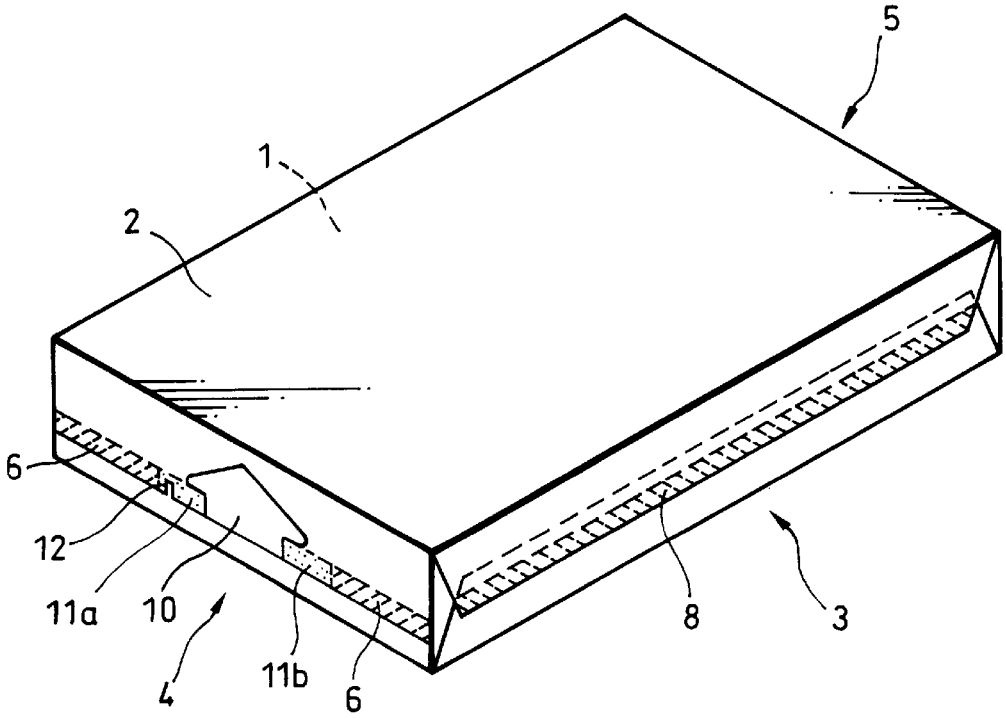
FIG. 5 is a perspective view of the outer packaging film according to the another embodiment.

FIG. 2 is a perspective view of an outer appearance of a cassette case in a packaged condition in which the same references as those in the conventional example illustrated in FIG. 5 are attached to the same parts as those of the conventional example.

An outer packaging film 2 used for wrapping a cassette case 1 is a transparent film made of, for example, polypropylene (pp) or the like and having an excellent toughness and heat adhesiveness, and the outer packaging film 2 in a packaging condition is sealed on a front face 3 of its body corresponding to the longitudinal direction of the cassette case 1, and on the left and right sides 4, 5 thereof.

Both end portions of the outer packaging film 2 are overlapped on the front face 3 of the body of the cassette case 1 and the overlapped portion is heat sealed to form a body adhered portion 6. Overlapped portions of the outer packaging film 2 on the left and right side faces 4, 5, of the cassette case, where the outer packaging film 2 wraps the cassette case 1 by a wrapping method for a caramel, for example, are also heat sealed to form a side adhered portion 8.

An non-adhered part, where no adhesive force acts, is formed in the center part of the body adhered portion 6 and the non-adhered part is used as an opening tap 10, when the outer packaging film 2 is unsealed. In the embodiment, the opening tap 10 has been formed in the shape of an arrow directing in an unsealing direction of the outer packaging film 2. A width a of the opening tap 10 is in the range of about 15 to 20 mm so that ends of fingers may pick up the opening tap 10 with ease.

Weakly adhered parts 11*a*, 11*b* having weaker adhesiveness than that of the body adhered portion 6 are formed adjacent to the left and right sides of the opening tap 10. In this case, the weakly adhered parts 11*a*, 11*b* are respectively formed such that a length b of each of them from each side edges of the opening tap 10 outwardly is set within the range of 20 to 30 mm.

A slit 12 is formed at the vicinity of the outer edge of one weakly adhered part 11*a* by cutting the end of the outer packaging film 2.

A printing method can be employed to form the non-adhered part, which is the opening tap 10, and the weakly adhered parts 11*a*, 11*b*. That is, since the outer packaging film 2 is molten and adhered by heat sealing, if a printing is made on its adhering surface, adhesion between the overlapped film portions is not effectively performed. Therefore, a degree of adhesiveness can be adjusted by a thickness of the printing layer.

Figure 3:
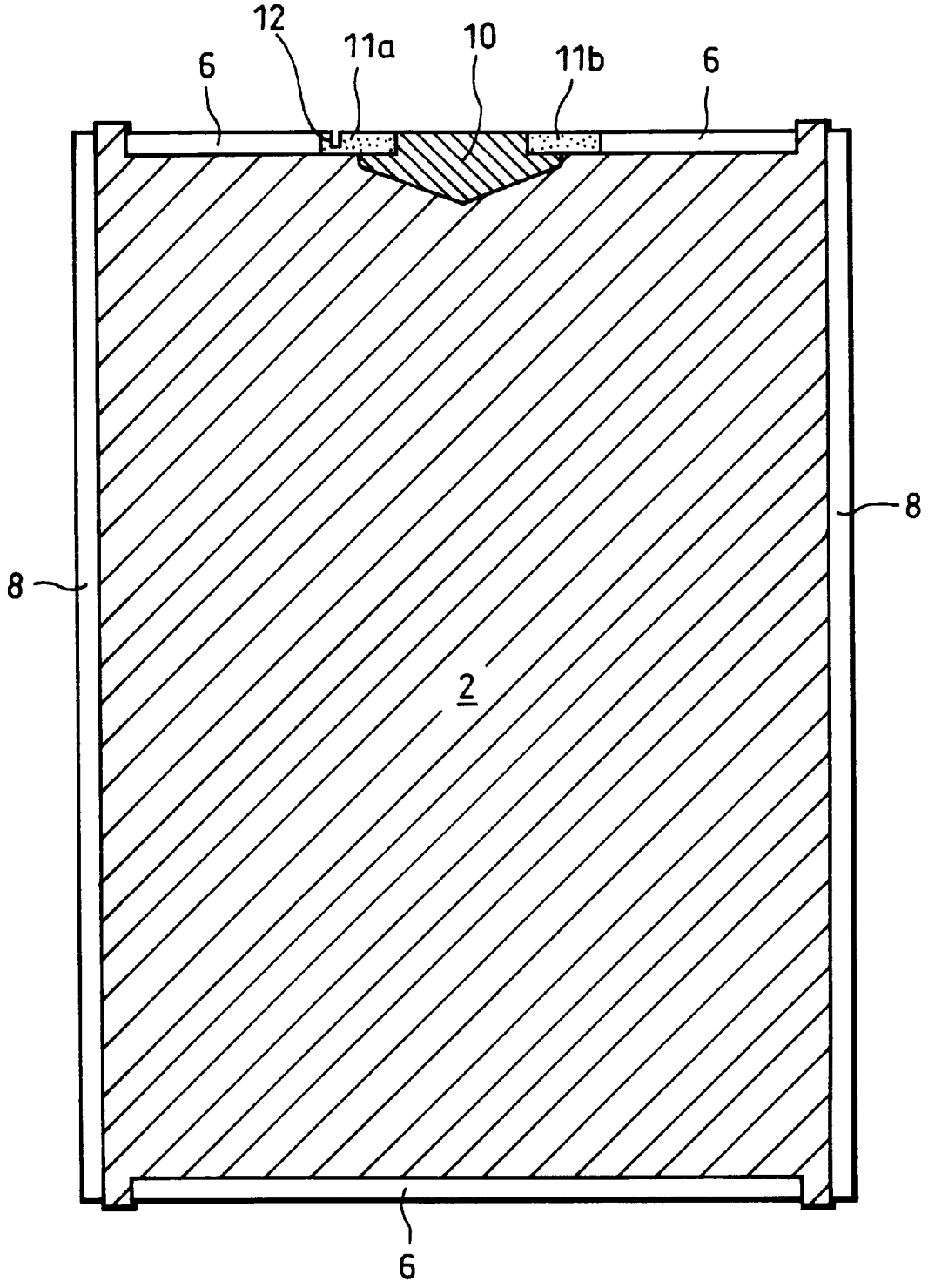
FIG. 3 is a plan view in a developed condition of the outer packaging film.

FIG. 3 shows a developed state of the outer packaging film 2 as viewed from the backside before packaging and the outer packaging film is subjected to printing in this condition.

In this case, portions of the body adhered portion 6 positioned at the top and bottom ends of the developed outer packaging film 2 are transparent portion with no printing. Therefore, the portions where the outer packaging film 2 is used for wrapping and the body adhered portions 6, 6 are overlapped with each other are strongly adhered by the heat seal.

Printing with a general printing thickness is performed in a part corresponding to the opening tap 10 as a non-adhered part. Therefore, even if the non-adhered part is overlapped on the body adhered portion 6, and heat sealing is performed thereon, the opening tap 10 is left in the non-adhered state.

A thin printing is performed on the weakly adhered parts 11*a*, 11*b* so that the weakly adhered parts exercise a weaker adhering force than that of the body adhered portions 6. Thereby, the weakly adhered parts 11*a*, 11*b* are overlapped on the body adhered portions 6 and subjected to heat sealing to be adhered by a weaker adhering force.

Portions of the side adhered portions 8, 8 located on left and right ends of the outer packaging film 2 in the developed state are left absolutely in no printing and transparent. When the outer packaging film 2 wraps by a wrapping method for wrapping a caramel and the faces of the out side overlapped portions are heat sealed, the above portions are adhered by a strong adhering force.

The whole face of the rest of the outer packaging film 2 other than the above mentioned portions or parts is subjected to an ordinary design printing. Therefore, as shown in FIG. 2, the outer packaging film 2, whose body adhered portion 6 and side adhered portion 8 are heat sealed and adhered, never adheres to the cassette case 1 which is an object to be packaged.

As the outer packaging film 2, polypropylene (PP) is used, as is commonly used in wide application, but if an oriented polypropylene (OPP), which shrinks more in a longitudinal direction in a heat treatment after packaging, is used, a packaging state becomes in a close and tight condition, so that a value as a commercial article can be increased.

Figure 4:
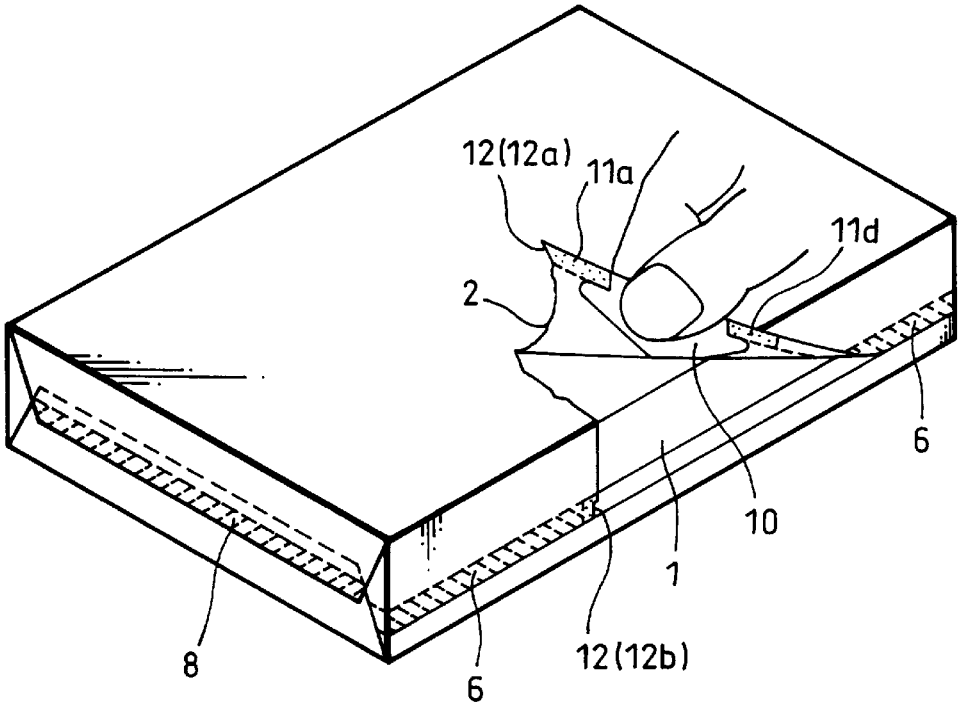
FIG. 4 is a perspective view of the outer packaging film in an unsealed condition.

An unsealing operation of the outer packaging film 2 in a packaging condition is started with hooking and picking up the opening tap 10 by tip ends of fingers. Thereby, the film portions of the weakly adhered parts 11*a*, 11*b* on the left and right sides of the opening tap 10 are peeled off from the sides thereof to the opening tap 10 and lifted up. When the weakly adhered parts 11*a*, 11*b* are peeled and the peeling action reaches the portion of the slit 12, one edge 12*a* of the slit 12 is lifted up, whereas the other inner end 12*b* thereof is left adhered (see FIG. 4). As a result, the slit 12 acts as a chance for the film to be torn from its cut opening. In the following stage, as shown in FIG. 4, the outer packaging film 2 is unsealed while the film 2 is torn wide open upwardly toward the top face side of the cassette case 1.

What is important in this case is a degree of adhesiveness of the weakly adhered part 11*a* in which the slit 12 is provided. For example, when the degree of adhesiveness thereof is too weak, the weakly adhered part 11*a* is peeled off together with the slit 12 in one draw and unsealing becomes unsuccessful without the tearing off of the slit 12. On the other hand, if the degree of adhesiveness of the weakly adhered part 11*a* is too strong, the weakly adhered parts 11*a*, 11*b* are not peeled off and the film is stretched out and hence its unsealing comes to be also unsuccessful.

Because of the above reason, the degree of adhesiveness of the weakly adhered parts 11*a*, 11*b* needs to be selected at such a proper weakness of adhesion that the slit 12 is torn.

In the present embodiment, the weakly adhered parts 11*a*, 11*b* are printed with a thin printing layer (which is about 0.6 $\mu$m in printing thickness) of printing of about 30% as a thin for the printing degree of the opening tap 10 (which is, for example, about 2 $\mu$m in printing thickness) so that the degree of adhesiveness in the weakly adhered parts 11*a*, 11*b* are adjusted.

As another method, when the thickness of the printing on the weakly adhered parts 11*a*, 11*b* is set almost same as the thickness (which is about 2 $\mu$m in printing thickness) of the non-adhered part to be used the opening tap 10, whereas an area of the printing on the weakly adhered parts 11*a*, 11*b* is adjusted to be about 70% of that on the opening tap 10%, it is possible to adjust the degree of adhesiveness in the weakly adhered parts 11*a*, 11*b*.

Depending on differences in the material of the outer packaging film of the packaging body, the object to be packaged or the like, if a thickness or area of printing in the weakly adhered parts 11*a*, 11*b* is modified for adjustment, for example, so as to increase the thickness or area (for example by 20% up) or decrease (for example, by 20% off), the packaging body can widely be applied to other objects to be packaged other than the cassette case.

The position of the slit 12 formed in the weakly adhered part 11*a* is preferably selected at a position with a distance c from the end edge of the opening tap 10 in the range of 10 to 20 mm, since an unsealing action is larger when the outer packaging film 2 is torn under the condition that the weakly adhered part 11*a* is peeled off by some extent together with the opening tap 10.

The reason why the slit 12 is only provided in the weakly adhered part 11*a* at the left side of the opening tap 10 is that in general, when the unsealing operation is conducted by finger tips of the right hand picking up the opening tap 10 of the outer packaging film 2, the film is easier to be torn off at the slit 12. However, if the slit 12 is provided for both weakly adhered parts 11*a*, 11*b* and the opening tap 10 is picked and peeled up, there arises an inconvenience that since both the slits 12 are torn at the same time only to make a part of the outer packaging film 2 torn off in the shape of a band, the outer packing film 2 remains on the side of the cassette case 1.

In the embodiment, the opening tap 10 is printed in a different color from the design printed on the outer packaging film 2. Thereby a location of the body opening tap 10 becomes easier to be recognized, which makes unsealing operation of the outer packaging film 2 more quickly.

Moreover, while the case where the opening tap 10 is located in the front face 3 of the outer packaging film 2 on the body, as shown in FIG. 5, according to a style of the packaging state of the outer packaging film 2, a packaging can be performed in a different way, that is, both the side faces 4, 5 of the outer packaging film 2 are set to have the overlapped portions which are adhered by the side adhered portions 6, 6, while the front face 3 of the body is wrapped by a wrapping method for a caramel and its overlapped portion is adhered by the adhered portion 8. In such a case of packing, a opening tap 10, which is constructed as a non-adhered part, is provided on one side face 4 and weakly adhered parts 11*a*, 11*b* are provided on both sides of the opening tap 10 together with a slit 12 formed in one weakly adhered part 11*a*. Therefore, the outer packaging film 2 in the construction shown in FIG. 5 is unsealed in the longitudinal direction of the cassette case 1.

According to the above mentioned packaging body, upon unsealing the outer packaging film 2, the tearing is positively started from the slit 12 with ease and the cassette case 1 can be taken out quickly, so that there is no chance to lose a timing for recording images or sounds in programs during broadcasting.

Further, since there is no need for a strong force for unsealing of the outer packaging film 2, a cassette case 1 has no chance to be broken down.

A non-adhered part serving as the opening tap 10 is not necessarily located in the center of the outer packaging film 2 in a packaging condition, but the location thereof may be any place where upon unsealing a majority of the outer packaging film 2 can be torn off.

In the embodiment, while as an object to be packaged, there is described a cassette case in which a tape cassette for a video a tape cassette for an audio or the like is accommodated, various objects to be packaged other than the above mentioned one can widely be applied with the present invention.

As has been described above, since the packaging body of the present invention is constructed in such a manner that the weakly adhered part having a low degree of adhesiveness is formed in a portion adjacent to the non-adhered part which becomes the opening tap upon unsealing, and the slit is formed in the weakly adhered part, the outer packaging film of the packaging body is with certainty torn at the slit upon unsealing, and hence the unsealing can be effected with no parts being left adhered and with swiftness of operation.

Moreover, since a strong force is not necessary upon unsealing, any risk for an object to be packaged to be broken down can be eliminated.

Having described the preferred embodiments of the present invention with reference to the accompanying drawings, it is to be understood that the present invention is not limited to the above-mentioned embodiment and that various changes and modifications can be effected therein by one skilled in the art without departing from the spirit or scope of the present invention as defined in the appended claims.

What is claimed is:

1. A package for packaging an object by wrapping an outer packaging film having an overlapped portion, wherein said outer packing film is sealed forming an adhered portion, comprising:

a non-adhered portion forming an opening tab for unsealing said outer packaging film by pulling thereof, wherein said opening tab is formed in a part of said adhered portion of said outer packaging film;

two weakly adhered portions having a lower degree of adhesiveness than said adhered portion provided in sections adjacent to said non-adhered portion; and a slit formed in only one of said two weakly adhered parts to facilitate the tearing of said outer packaging film when said opening tab is pulled.

2. The package according to claim 1, wherein said non-adhered portion and said two weakly adhered portions adherence is adjusted by controlling a thickness of a printing layer.

3. The package according to claim 1, wherein said object to be wrapped is a cassette case.

4. The package according to claim 1, wherein a length of each of said two weakly adhered portions is larger than a length of said non-adhered portion.

* * * * *